United States Patent [19]

Roberts et al.

[11] 3,959,659

[45] May 25, 1976

[54] INTENSE, ENERGETIC ELECTRON BEAM ASSISTED FUSION NEUTRON GENERATOR

[75] Inventors: Thomas G. Roberts; Romas A. Shatas; Harry C. Meyer, III; John D. Stettler, all of Huntsville, Ala.

[73] Assignee: The United States of America as represented by the Secretary of the Army, Washington, D.C.

[22] Filed: Apr. 4, 1974

[21] Appl. No.: 457,868

[52] U.S. Cl. ..... 250/501; 313/61 S

[51] Int. Cl.[2] ..... G21G 4/02

[58] Field of Search ..... 250/492, 493, 499, 500, 250/501, 502; 313/61 S

[56] References Cited

UNITED STATES PATENTS

| | | | |
|---|---|---|---|
| 3,526,575 | 9/1970 | Bennett | 250/500 |
| 3,746,860 | 7/1973 | Shatas | 250/493 |
| 3,748,475 | 7/1973 | Shatas | 250/502 |
| 3,766,004 | 10/1973 | Roberts | 250/502 |
| 3,864,640 | 2/1975 | Bennett | 250/500 |

*Primary Examiner*—Craig E. Church

*Attorney, Agent, or Firm*—Nathan Edelberg; Robert P. Gibson; James T. Deaton

[57] ABSTRACT

Energetic electron beam assisted fusion neutron generator which comprises a plasma generator and an electron source interconnected by a pinch tube and control means for the plasma generator, electron source, and said pinch tube to cause the electron source to be focused on the plasma from the plasma generator and to cause the electron source to be transmitted to the plasma of the plasma generator at the appropriate time to cause a maximum amount of neutrons to be produced by the interaction of the outputs of the plasma generator and the electron source through an appropriate gas filling the plasma generator.

3 Claims, 2 Drawing Figures

INTENSE, ENERGETIC ELECTRON BEAM ASSISTED FUSION NEUTRON GENERATOR

BACKGROUND OF THE INVENTION

Until recently pulses of neutrons could be obtained from plasma generators like those developed in research on controlled thermonuclear devices, from pulsed fission reaction, and from laser created plasma where a high energy pulse of laser radiation is used to heat a target of solid deuterium. It is now also feasible to use pulsed laser radiation to heat the plasma of generators like the coaxial plasma gun to obtain intense pulses in excess of $10^{11}$ neutrons per burst such as disclosed in U.S. Pat. No. 3,766,004. However, it should be pointed out that any method which heats the plasma during a very short time (nanoseconds) produces the same results, and the most intense pulses of neutrons which are obtained from the fission reactors are very expensive and produce radioactive waste.

Absorption of some of the energy of an electron beam by a plasma would increase its temperature and thereby increase the number of neutrons produced by the plasma. When the plasma temperature is increased the neutron production goes up by the ratio of $\overline{\sigma v}$ at the final temperature to $\overline{\sigma v}$ at the initial temperature. Here $\overline{\sigma v}$ is the product of the relative velocity $v$ and the reaction cross section $\sigma$ averaged over the velocity distribution of the nuclei. For the conditions produced in the plasma gun, doubling the temperature can cause an order of magnitude increase in the neutron yield.

Therefore, it is an object of this invention to provide a plasma generator that utilizes the interaction of an electron beam with a plasma to provide an additive heating effect of the plasma to produce neutrons.

Another object of this invention is to arrange and control the interaction of the plasma with the electron beam such that the electron beam energy is focused onto the very small volume of dense hot plasma of the plasma generator.

A further object of this invention is to focus the electrons from the electron beam source utilizing a pinch tube.

Still another object of this invention is to affect the orbits of the electrons from the electron source as they approach the dense hot plasma by the effects from the fields of the pinch tube.

SUMMARY OF THE INVENTION

In accordance with this invention, a neutron generator is provided that includes an internal source of high energy electrons such as a modern flash X-ray machine operated in the electron beam mode, a beam forming and guiding section such as a linear pinch device, and a plasma generator such as a coaxial plasma gun arranged and operated so that the high energy electron beam is focused onto and retained near the volume where the high density plasma is produced. The timing of the events is accomplished by using a photocontrolled means to determine when the plasma is in the desired volume and when the high energy electron beam will reach the desired volume.

DESCRIPTION OF THE PREFERRED EMBODIMENT

Figure 1:
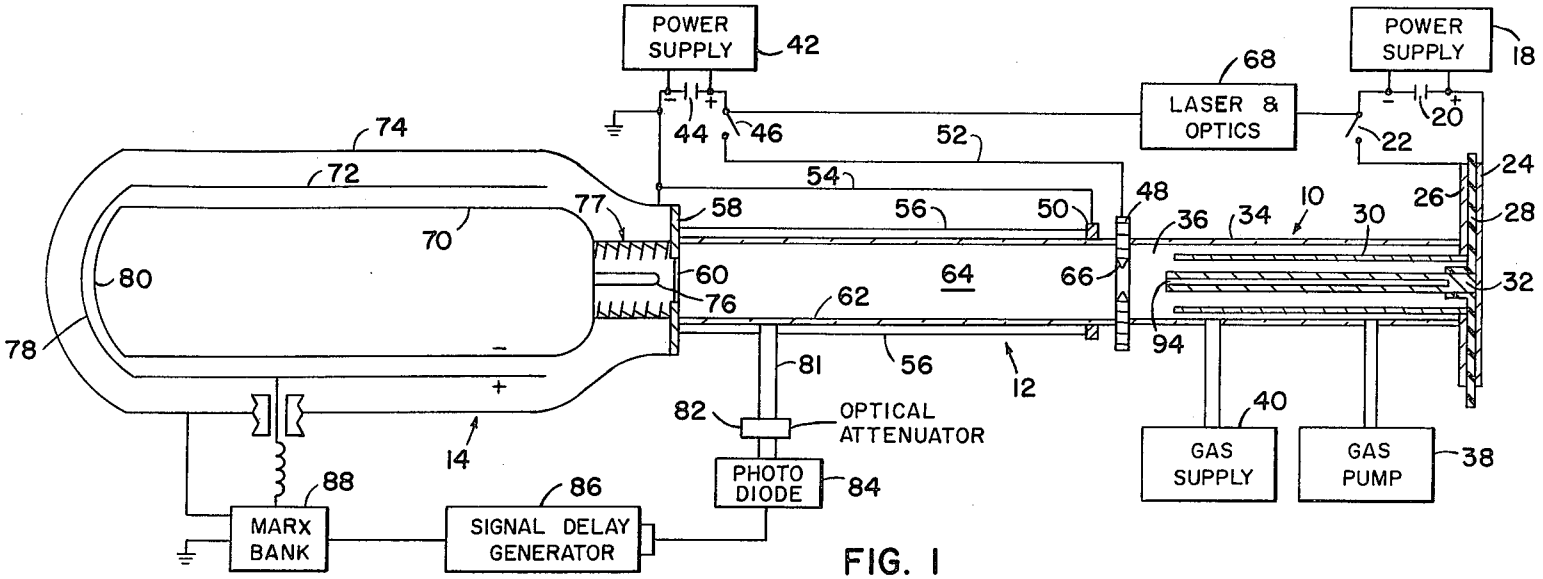
FIG. 1 is a schematic structural view of a neutron generator according to this invention.
Figure 2:
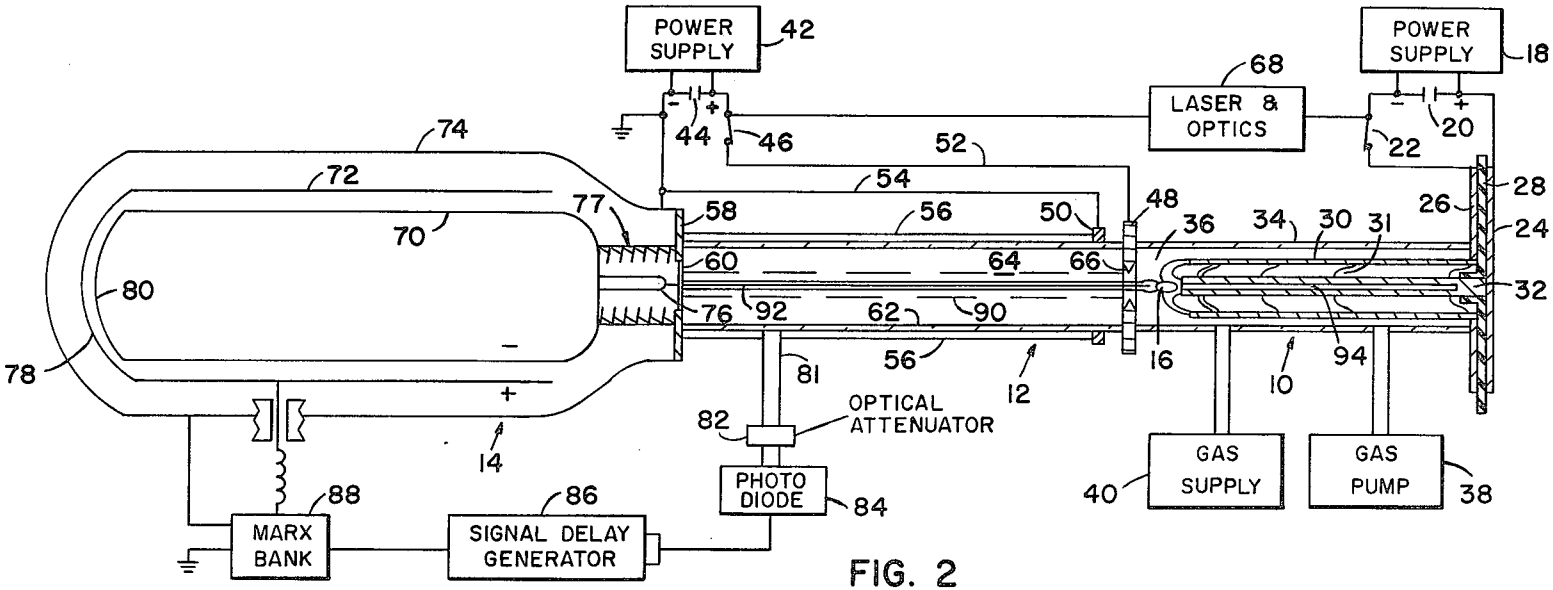
FIG. 2 is a schematic structural diagram of a neutron generator depicted in an operating condition according to this invention.

Referring now to FIGS. 1 and 2, the apparatus according to this invention includes a plasma generator 10, a linear pinch tube device 12 and an electron beam source 14. The plasma generator 10, linear pinch tube device 12, and electron beam source 14 are axially aligned for concentrating their energies in a plasma volume 16 such as illustrated in FIG. 2. Power supply 18 is provided for plasma generator 10 and the electrical system thereof includes a condenser bank 20 and starting switch 22 that are connected to outer conductor 24 and inner conductor 26. Inner and outer conductors 24 and 26 are separated by an insulator 28. Outer conductor 24 is electrically connected to inner electrode 32 of the plasma gun portion of plasma generator 10 and inner conductor 26 is connected to outer electrode 30 of the plasma gun. An outer housing 34 generally made of glass incloses the plasma gun to form a chamber 36 therein. A gas pump 38 is connected into housing 34 for evacuating chamber 36 and gas supply 40 is connected to housing 34 for supplying gases to chamber 36.

Power supply 42 is provided for linear pinch tube device 12 and the electrical system thereof includes a condenser bank 44 and starting switch 46. Condenser bank 44 and starting switch 46 are connected to electrodes 48 and 50 by leads 52 and 54. Electrode 50 is connected to a plurality of approximately eight wires 56 that are also connected to electrode 58. Electrode 58 has window 60 mounted therein in a conventional manner to close one end of glass tube 62 and form chamber 64 between electrodes 48, 58, and tube 62. Electrode 48 has opening 66 therein to allow communication between chambers 36 and 64. For a more detailed explanation of the structure of the conventional linear pinch tube device, consult the publication Plasma Physics, volume 10, pp. 381–389, by T. G. Roberts and W. H. Bennett. Switch 46 of linear pinch tube device 12 and switch 22 of plasma generator 10 are coupled to conventional laser and optics device 68 for simultaneously firing plasma generator 10 and linear pinch tube device 12. Device 68 accomplishes the simultaneous firing of plasma generator 10 and linear pinch tube device 12 and the jitter is of the order of 1 nanosecond.

Electron source 14 consists of an internal source of high energy electrons such as a modern flash X-ray machine operated in the electron beam mode, and as illustrated includes three coaxial cylinders 70, 72, and 74. Inner cylinder 70 is connected to high voltage terminal 76 of discharge tube 77. Rounded end 78 of intermediate cylinder 72 is close to rounded end 80 of inner cylinder 70. Outer cylinder 74 forms the wall of the cylindrical tank of the electron source which is filled with oil or an insulating gas everywhere except in the discharge tube. It is to be understood that other electron producing sources other than that illustrated can be used in this invention.

Control means for electron energy source 14 include operationally connected light pipe 81, optical attenuator 82, photo-diode 84, signal delay generator 86, and Marx bank 88 that is conventionally connected to electron energy source 14 as illustrated. Marx bank 88 as illustrated contains its own power supply and the Marx bank is normally charged being in condition for discharge upon the appropriate signal from signal delay generator 86.

In operation, refer to FIG. 2. Before operation of the device is begun, plasma generator 10 and linear pinch tube device 12 are filled to the desired pressures with the gases to be used. The gases to be used in the plasma generator and the linear pinch tube device are preferably deuterium-tritium but may also be deuterium, tritium, or deuterium and $^3$He. As illustrated, power supplies 18 and 42 have charged their respective condenser banks 20 and 44. The device is now ready for operation by causing laser and optics 68 to simultaneously close starting switches 22 and 46. The closing of switch 22 causes the voltage of the condenser bank 20 to appear across the electrodes of the plasma focus gun and the gas in the coaxial plasma generator breaks down near insulator 28 forming current sheath 31. Current sheath 31 then propagates between the outer electrode 30 and inner electrode 32 and is driven by the magnetic pressure of its own magnetic field. The discharge becomes more intense as the sheath propagates. When current sheath 31 reaches the end of electrodes 30 and 32, it folds back on itself and rapidly collapses the plasma toward the axis of plasma generator 10 as in a Z-pinch. This produces hot plasma volume 16 where electron or ion number density may be as high as $10^{19}$ cm$^{-3}$, the temperature may be as high as several times $10^{7°}$ Kelvin and the confining magnetic fields of the order of megagauss. At this time and for a period of the order of a microsecond, neutrons are produced. The velocity of the propagation of current sheath 31 and therefore the time of collapse of the plasma toward the axis is a function of the voltage on condenser bank 20.

During the same time period, the voltage of condenser bank 44 due to the simultaneous closing of switches 22 and 46, has appeared across electrodes 48 and 58 of linear pinch device 12. The gas in linear pinch device 12 breaks down along the glass wall of enclosure 62 between electrodes 48 ad 58. Current sheath 90 then leaves the wall of tube 62 and moves radially inward toward the axis of linear pinch device 12. The velocity with which this current sheath approaches the axis of the linear pinch device is a function of the voltage on condenser bank 44. As current sheath 90 moves toward the axis of linear pinch device 12, the light produced increases in intensity and the light is detected by light pipe 81 which carries the detected light to photo-diode 84 after having passed through optical attenuator 82. Optical attenuator 82 is preset so that accidental changes in the light intensity will not cause signal delay generator 86 to begin to operate until current sheath 90 has reached a predetermined location along the radius of linear pinch device 12. Light pipe 81 and photo-diode 84 are used partially to insure that noise does not start signal delay generator 86 to function too soon. The signal which starts signal delay generator 86 is delayed a preset amount and is then used to erect Marx bank 88 of electron source 14 to cause high energy electrons to enter linear pinch tube device 12 through thin window 60 from electrode 76. Once the high energy electrons find themselves in the medium of linear pinch tube device 12, their space charge is neutralized and they form a relativistic pinched beam 92 which is guided by the magnetic field of linear pinch tube device 12 to electrode 48 which does not have a material window. When the beam of high energy electrons pass electrode 48, they tend to diverge but before the beam expands much it is in the presence of the high magnetic fields of dense plasma 16. The high magnetic fields of the dense plasma are arranged so that the high energy electrons are again focused onto the volume which contains the high temperature, high density plasma. Thus, heating this plasma to even higher temperatures, and also causing the volume to constrict even more which also raises the temperature of the plasma. In this manner, the neutron yield from fusion reactions is substantially increased.

In order to operate the neutron generator again, one must first change the gases in linear pinch device 12 and plasma generator 10 by utilizing gas pump 38 and gas supply 40, and by recharging condenser banks 20, 44 and Marx bank 88. It may also be necessary from time to time to replace window 60, but having the end of electrode 32 open as illustrated at 94 will reduce the frequency with which this must be done.

In the production of neutrons, great care must be taken to insure that the plasma in plasma generator 10 is clean (free of high Z material) and that no high Z material is carried in with the electron beam. This is accomplished in this invention by using linear pinch device 12 to pick up and form the intense high energy electron beam and by having no material window in electrode 48 between linear pinch device 12 and plasma generator 10. Also, in this arrangement, the ambient gas in the linear pinch device 12 and the plasma generator 10 are the same and are at the same pressure, but the density of the plasma in linear pinch device 12 during the same time of transient of the electron beam is several orders of magnitude less than that of the plasma in plasma generator 10 at the time of arrival of the electron beam. The magnetic field configuration of this invention is such that the beam is transmitted by the linear pinch tube device. Thus, the interaction of the electron beam with the plasma in the linear pinch tube device is only slight.

We claim:

1. An electron beam assisted fusion neutron generator comprising a plasma generator; a source of high energy electrons; and a beam forming and guiding section interconnecting said source of high energy electrons and said plasma generator; and control means for the plasma generator, the beam forming and guiding section, and the source of high energy electrons for causing neutrons to be produced from interaction of a plasma produced by the plasma generator and electrons from said source of high energy electrons, said beam forming and guiding section being a linear pinch device and said control means for said beam forming and guiding section and said plasma generator including a rechargeable capacitor bank for each of said beam forming and guiding section and said plasma generator, and control means for simultaneously firing each capacitor bank to cause said plasma generator to produce a plasma and said linear pinch device to produce a current sheath for guiding electrons from said source of high energy electrons, said control means for said source of high energy electrons including means responsive to the current sheath produced in said linear pinch device to cause said source of high energy electrons to be emitted in response to a predetermined current sheath condition being established, and said linear pinch device and said plasma generator have chambers that are filled with gases selected from the group consisting of deuterium-tritium, deuterium, tritium, and deuterium $^3He$.

2. An electron beam assisted fusion neutron generator as set forth in claim 1, wherein said plasma generator includes an inner electrode that has a bore therein.

3. An electron beam assisted fusion neutron generator as set forth in claim 1, wherein aid gases are deuterium-tritium.

* * * * *